US006470153B2

(12) United States Patent
Uehara

(10) Patent No.: US 6,470,153 B2
(45) Date of Patent: Oct. 22, 2002

(54) DEVELOPING DEVICE AND DEVELOPING METHOD FEATURING A USE-RELATED CONTROL OF A FIRST VOLTAGE AND A SECOND VOLTAGE RESPECTIVELY, APPLIED TO A DEVELOPER BEARING MEMBER AND A DEVELOPER CHARGING MEMBER

(75) Inventor: Shinji Uehara, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/888,417

(22) Filed: Jun. 26, 2001

(65) Prior Publication Data

US 2002/0009305 A1 Jan. 24, 2002

(30) Foreign Application Priority Data

Jul. 4, 2000 (JP) ..... 2000-202747

(51) Int. Cl.[7] ..... G03G 15/06

(52) U.S. Cl. ..... 399/55; 399/281; 399/285

(58) Field of Search ..... 399/44, 46, 49, 399/55, 58, 59, 72, 272, 281, 285

(56) References Cited

U.S. PATENT DOCUMENTS 6,134,397 A * 10/2000 Shimazaki et al. ..... 399/55
6,226,466 B1 * 5/2001 Ojima et al. ..... 399/49

* cited by examiner

*Primary Examiner*—Hoang Ngo
(74) *Attorney, Agent, or Firm*—Fitzpatrick, Cella, Harper & Scinto

(57) ABSTRACT

A developing device and a developing method are provided which are capable of steadily supplying sufficiently charged toner to an image bearing member over a long period and always giving a high image quality.

14 Claims, 18 Drawing Sheets

DEVELOPING DEVICE AND DEVELOPING METHOD FEATURING A USE-RELATED CONTROL OF A FIRST VOLTAGE AND A SECOND VOLTAGE RESPECTIVELY, APPLIED TO A DEVELOPER BEARING MEMBER AND A DEVELOPER CHARGING MEMBER

BACKGROUND OF THE INVENTION

1. Field of the Invention

The present invention relates to a developing device and a developing method, and in particular to an image forming apparatus such as an electrophotographic copying machine and an electrophotographic printer, and a developing device and a developing method that are applied to such an image forming apparatus.

2. Description of the Related Art

Conventionally, as an electrophotographic method, there is a method of utilizing a photoconductive material to form an electric latent image on a photosensitive drum by various ways, subsequently developing the latent image with toner to visualize it, transferring a toner image on a transfer material such as a sheet depending on a situation, and then fixing the toner image by heat, pressure or the like to obtain a copy.

On the other hand, since improvement of image resolution, definition, and the like is currently required, development of a method of forming a thin layer of toner and an apparatus for the method is essential, and several measures have been proposed to fulfill the requirement.

In recent years, a contact single component developing method has been proposed, which performs development with a configuration for pressing against a surface layer of a photosensitive drum using a semiconductive developing roller or a developing roller having a dielectric layer formed on its surface.

Here, a schematic sectional view of a conventional image forming apparatus using a DC contact single component developing method is shown in FIG. 17. In this method, a photosensitive drum 61 and a developing roller 65 abut each other. First, the photosensitive drum 61 is charged by a charging roller 62, and a latent image is formed on the photosensitive drum 61 by a laser beam from an exposing unit 63.

Then, the latent image is visualized by a developing device 64. Thereafter, toner 68 on the developed image is transferred to a transfer material 13 by a transferring roller 9. The toner 68 that was not transferred and remains on the photosensitive drum 61 is scraped off by a cleaning blade 10 and contained in a cleaning container 69.

This developing device 64 has an elastic roller 66 that is in pressurized contact with the developing roller 65 at a position on the upstream side in the rotating direction of the developing roller 65 from an elastic blade 67 inside a developer container 60 containing nonmagnetic toner 68 as a single component developer. The elastic roller 66 rotates in the direction of an arrow D to supply the toner 68 on the developing roller 65. The toner 68 supplied on the developing roller 65 is conveyed in accordance with the rotation of the developing roller 65 and is given a charge by friction at the abutment part of the elastic blade 67 and the developing roller 65 to form a thin layer.

Then, the toner 68 forming the thin layer is conveyed by the developing roller 65 and is supplied for development of an electrostatic latent image at the abutment part with the photosensitive drum 61. Thereafter, the toner 68 that was not used for development in the abutment part of the photosensitive drum 61 and the developing roller 65 and remains on the developing roller 65 is scraped off by the elastic roller 66.

In addition, new toner 68 is supplied to the developing roller 65 by the elastic roller 66 as described above, and the above-mentioned actions are repeated. In addition, the above-mentioned single component developer consists of toner prepared by internally or externally adding an auxiliary agent to base resin according to necessity. An auxiliary agent to be internally added is represented by a charging polarity agent, and an auxiliary agent to be externally added is represented by a plasticizer.

Further, in the developing method using the DC contact single component developing method, it is necessary to convey sufficiently charged toner to a developing region and visualize a latent image by such toner in order to form a visualized image with high quality of a predetermined density.

However, it is extremely difficult to convey sufficiently charged toner to a developing region over a long period. This is because triboelectric property is lowered due to deterication of a developing roller, an elastic blade and an elastic roller resulting from a multiplicity of times of frictions, and toner is deteriorated due to separation of externally added agent.

Therefore, in recent years, a method of using means for electrically charging toner using a toner charging roller for the purpose of high triboelectric stability and fog reduction has been proposed as disclosed in Japanese Patent Application Laid-open No. Hei 11-119546 and Japanese Patent Application Laid-open No. Hei 11-119547.

Here, a developing method using a toner charging roller is shown in FIG. 18. FIG. 18 is a schematic sectional view of a developing device of a contact developing method using a conventional toner charging roller. This developing device is an apparatus of the above-mentioned method to which a toner charging roller 72 is attached. The developing device has an elastic roller 76 that is in pressurized contact with a developing roller 75 at a position on the upstream side of the rotating direction of the developing roller 75 from an elastic blade 73 inside a developer container 70 containing nonmagnetic toner 74 as a single component developer. The elastic roller 76 rotates in the direction of an arrow D to supply the toner 74 on the developing roller 75.

The toner 74 supplied on this developing roller 75 is conveyed in accordance with the rotation of the developing roller 75 and is given charge by friction at the abutment part of the elastic blade 73 and the developing roller 75 to form a thorn layer.

Moreover, the toner 74 is given charge electrically by discharge of the toner charging roller 72. Then, the toner 74 to which charge is given is conveyed by the developing roller 75 and is supplied or development of an electrostatic latent image at the abutment part with a photosensitive drum 71.

Thereafter, the toner 74 that was not used for development at the abutment part of the photosensitive drum 71 and the developing roller 75 and remains on the developing roller 75 is scraped off by the elastic roller 76. In addition, new toner 74 is supplied to the developing roller 75 by the elastic roller 76 as described above, and the above-mentioned actions are repeated.

If the above-mentioned toner charging roller is used, toner can be conveyed to a developing region of sufficiently charged toner even it an amount of toner charge (hereinafter referred to as a toner charge amount) decreases due to use over a long period, and an image defect such as a fog can be prevented.

However, even if a toner charging roller is used, a toner charge amount changes over time due to separation of an externally added agent of toner, etc. As a result, there is a problem in that an image quality varies in such a case in which image densities at an initial time of use and after a long term use are different.

SUMMARY OF THE INVENTION

The present invention has been devised in view of the above and other drawbacks, and it is an object of the present invention to provide a developing device and a developing method that are capable of steadily supplying sufficiently charged toner over a long period of time and always giving a high image quality.

In order to solve the above problem, a developing device in accordance with the present invention comprises: a developer bearing member for bearing and conveying a developer in order to apply the developer to an image bearing member, wherein a first voltage is applied to the developer bearing member; further comprising a developer charging member for charging the developer born by the developer bearing member, a second voltage is applied to the developer charging member and controlling means for variably controlling a potential difference between the first voltage and the second voltage are provided.

In this case, in the present invention, the developer bearing member and the developer charging member may be formed in a roller shape, for example, the developer bearing member may be configured of a developing roller, or the developer charging member may be configured of a toner charging roller.

Further, in the present invention, the controlling means controls the potential difference according to information concerning a use state of the developing device. In this case, a developing device wherein the information concerning a use state or the developing device, may be a number of times of image forming operations applied to the image bearing member by the developing device. Further, according to the present invention, an image is formed on a recording material using the image bearing member, and the information concerning a use state of the developing device may be a number of recording materials on which an image is formed. Further, the information concerning a use state of the developing device may be a number of rotations of the developer bearing member. Further, the information concerning a use state of the developing device may be a duration of applying the first voltage.

Further, according to the present invention, the developing device has a storage medium for storing the information.

Further, the developing device is provided in a cartridge that is detachably attachable to the main body of an image forming apparatus, and the cartridge has the storage medium for storing the information.

Further, according to the present invention, the potential difference in forming an image is determined according to densities of a plurality of pattern images that are formed using the developing device by changing the potential difference. Further, according to the present invention, the developing device has density detecting means for detecting the densities of the pattern images.

Further, according to the present invention, the developing device and the image bearing member are provided in an image forming apparatus, and the image forming apparatus has density detecting means for detecting the densities of the pattern images.

Further, according to the present invention, the cartridge is provided with the image bearing member, and the developing device may be provided in a process cartridge, which is detachably attachable to a main body of an image forming apparatus, together with the image bearing member. Further, the developing device and the image bearing member may be provided in an image forming apparatus.

In addition, in the present invention, a developing method is provided which applies a first voltage to a developer bearing member that conveys a developer in order to apply the developer to an image bearing member, applies a second voltage to a developer charging member that charges the developer borne by the developer bearing member and variably controls a potential difference between the first and second voltage.

Therefore, according to the present invention, the controlling means for controlling a potential difference between a first voltage applied to an image bearing member and a second voltage applied to a developer charging member is provided. Thus, even if conditions for forming an image are changed, a sufficiently charged developer can be provided steadily.

In addition, a potential difference between a first voltage and a second voltage is controlled based on a use state of the image forming apparatus such as the number of times of image forming operations executed by the developing device. Thus, a developer with an appropriate charge state can be provided according to a change accompanying the use of the image forming apparatus.

In addition, the developing conditions controlling means defines a potential difference between a first voltage applied to the developer bearing member and a second voltage applied to the developer charging member in forming an image based on the density data read by the density detecting means. Thus, an appropriate potential difference between the first voltage and the second voltage can be determined according to a state of the image forming apparatus In addition, convenience of a user can be improved because the developing device and the image bearing member are provided in the process cartridge detachably attachable to the image forming apparatus.

DETAILED DESCRIPTION OF THE PREFERRED EMBODIMENT

Figure 1:
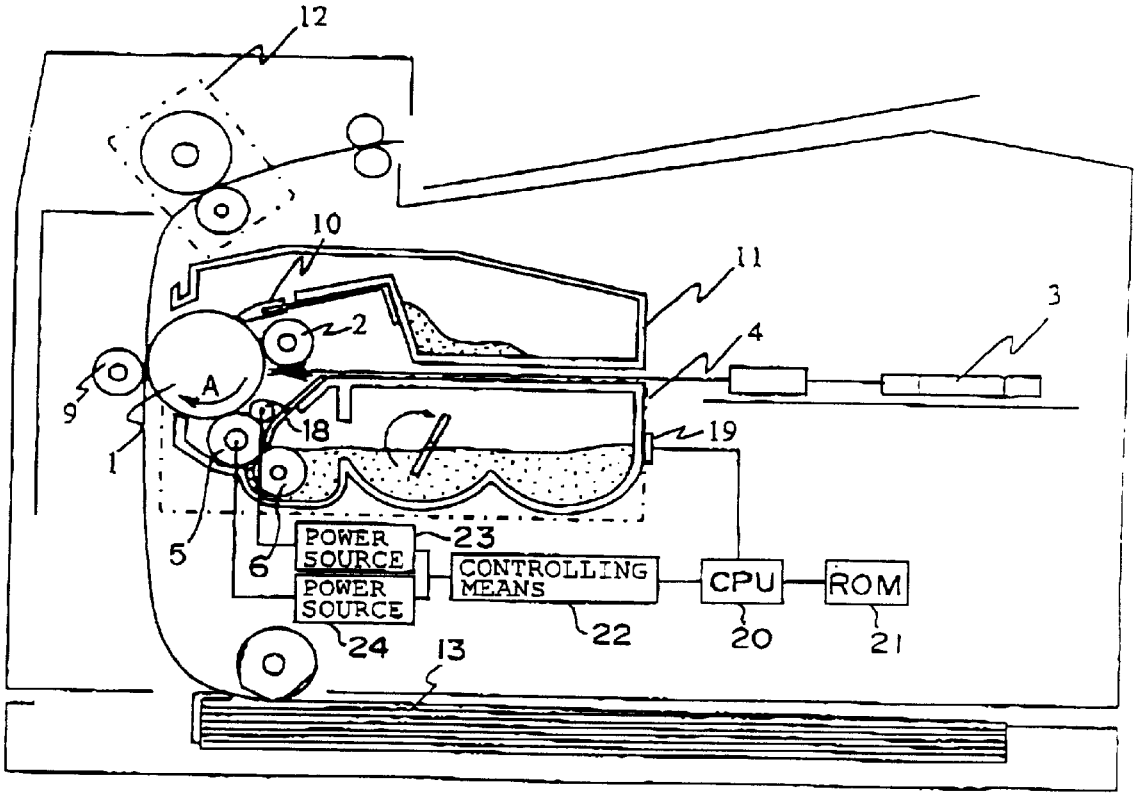
FIG. 1 is a schematic sectional view of an image forming apparatus using an first embodiment of a developing device in accordance with the present invention.

Preferred embodiments of the present invention will be hereinafter described in detail by means of illustration with reference to drawings. However, dimensions, materials and shapes of components and relative arrangement of them described in the embodiments do not intend to limit the scope of the present invention to them unless specifically described otherwise.

In addition, same reference numerals are given to members similar to those shown in drawings used for the above-mentioned conventional art and those shown in drawings already referred to.

[First Embodiment]

A first embodiment of a developing device in accordance with the present invention will be described with reference to the attached drawings. Further, descriptions of each embodiment of the developing device in accordance with the present invention to be hereinafter described also serve to describe each embodiment of an image forming apparatus and a process cartridge in accordance with the present invention.

Figure 2:
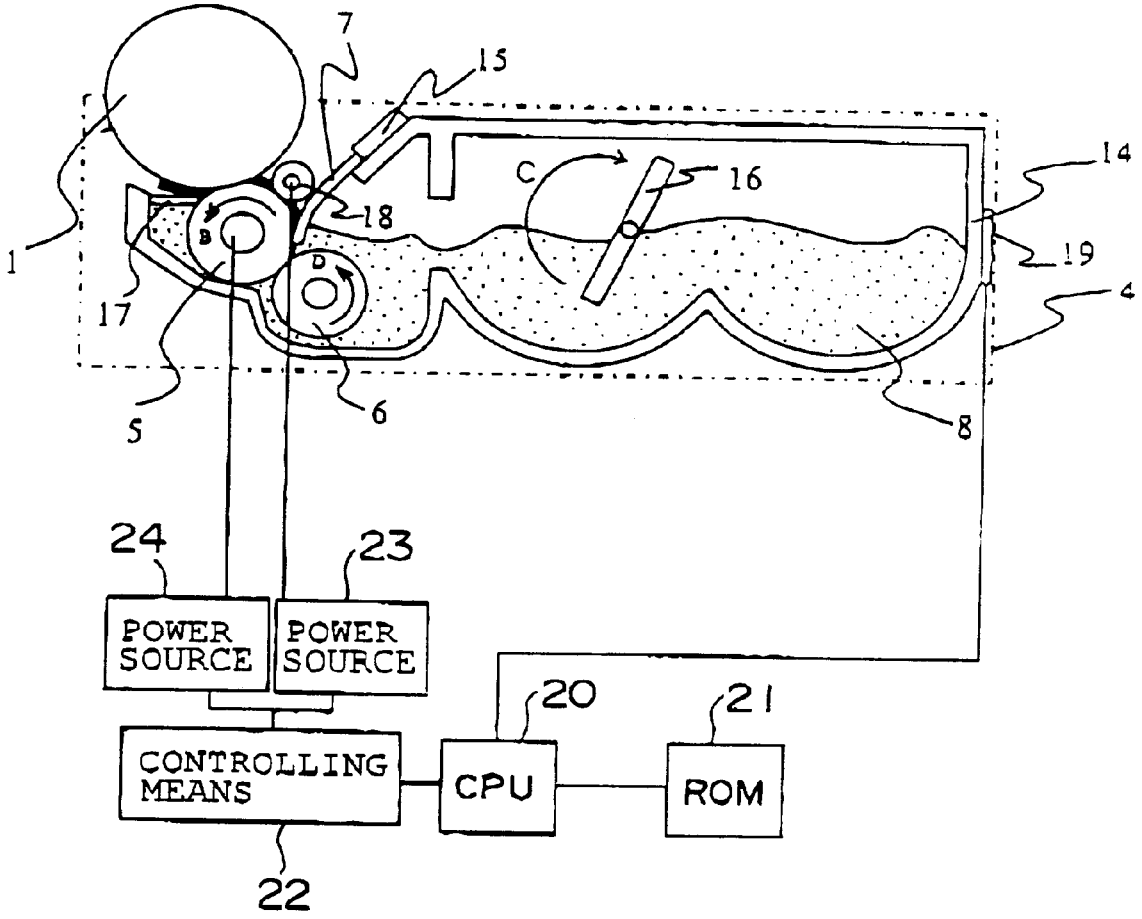
FIG. 2 is a sectional view of the developing device provided in the image forming apparatus shown in FIG. 1.

FIG. 1 is a schematic sectional view of an image forming apparatus using the first embodiment of the developing device in accordance with the present invention. FIG. 2 is a sectional view of the developing device provided in the image forming apparatus shown in FIG. 1.

In FIG. 1, a photosensitive drum 1 as an image bearing member being a component of the present invention rotates in an arrow A direction and is equally charged by a charging device 2 for charging the photosensitive drum 1. Then, an electrostatic latent image is formed on the surface of the photosensitive drum 1 by a laser beam from an exposing unit 3 for writing an electrostatic latent image on the photosensitive drum 1.

This electrostatic latent image is developed by a developing device 4 that is disposed adjacent to the photosensitive drum 1 and is detachably attachable to the image forming apparatus, and is visualized as a toner image. Incidentally, development for forming a toner image on an exposed part, which is referred to as reversal development, is performed in this embodiment.

The visualized toner image on the photosensitive drum 1 is transferred to a transfer material 13 by a transferring roller 9. Transfer residual toner that was not transferred and remains on the photosensitive drum 1 is scraped off by a cleaning blade 10 and contained in a waste toner container 11. The cleaned photosensitive drum 1 repeats the above-mentioned actions to form images.

On the other hand, the transfer material 13 on which the toner image is transferred is applied to fixing processing by a fixing device 12 and discharged outside the apparatus to complete the printing operation.

The developing device 4 in accordance with this embodiment will be further described based on FIG. 2. In FIG. 2, reference numeral 14 denotes a developer container containing nonmagnetic toner 8 as a single component developer. The developing device 4 is provided with a developing roller 5 as a developer bearing member being a component of the present invention, which is positioned at an opening part extending in the longitudinal direction inside the developer container 14 and is disposed to oppose the photosensitive drum 1. The developing device 4 thereby develops and visualizes an electrostatic latent image on the photosensitive drum 1. Then, the developing roller 5 contacts the photosensitive drum 1 over an abutment width.

In the above-mentioned developing device 4, an elastic roller 6 is abutted on the upstream side in the rotating direction of the developing roller 5 with respect to an abutment part with the surface of the developing roller 5 of an elastic blade 7. The elastic roller 6, is rotatably supported at the same time. As the elastic roller 6, one with a foamed skeleton-like sponge structure or a fur brush structure having fiber of rayon, nylon, or the like planted on a core metal is preferable from the viewpoint of supplying the toner 8 to the developing roller 5 and scraping unused toner. In this embodiment, the elastic roller 6 with a diameter of 16 mm provided with polyurethane foams on a core metal is used.

A width of 1 to 8 mm is effective as an abutment width between the elastic roller 6 and the developing roller 5. It is preferable to give a relative speed to the developing roller 5 at the abutment part. Thus, the abutment width is set as 3 mm, and the elastic roller 6 is driven to rotate at a predetermined timing by driving means (not shown) such that a peripheral speed of the elastic roller 6 becomes 50 mm/s (the relative speed with the developing roller 5 is 130 mm/s) at the time of development operation.

The elastic blade 7 is provided such that it is supported by a blade supporting plate 15 and is abutted in surface in contact with the circumference surface of the developing roller 5 in the vicinity of the end on its free end side. This structure consists of a rubber material such as silicon and urethane or a material formed by using an SUS or a metal thin plate of phosphor bronze having spring elasticity as a base body and adhering a rubber material on its abutment surface side with the developing roller 5.

In addition, the abutment is in the direction in which the end side is positioned on the upstream side in the rotating direction of the developing roller 5 with respect to the abutment part, which is referred to as a counter direction. In this embodiment, the elastic blade 7 has a configuration with a plate-like urethane rubber of the thickness of 1.0 mm adhered to the blade supporting plate 15. In addition, an abutment pressure against the developing roller 5 is set at 0.245 to 0.343 N/cm (measurement of a linear load is calculated from a value found by inserting three metal thin plates with known friction coefficients in the abutment part and pulling out one in the middle by a spring scale).

In addition, the above-mentioned developing roller 5 protrudes into the developer container 14 at its substantially right half circumferential surface in the above-mentioned opening part, and is horizontally disposed while being exposed outside the developer container 14 at its substantially left half circumferential surface. The surface exposed outside the developer container 14 contacts and opposes the photosensitive drum 1 positioned to the left of the developing device 4.

The developing roller 5 is driven to rotate in an arrow 3 direction. Its surface has high probability of rubbing with the toner 8 and has moderate unevenness for conveying the toner 8 smoothly. In this embodiment, the developing roller 5 uses the elastic roller 6 having acrylic urethane series coated on a silicon rubber layer with a diameter of 16 mm, a length of 216 mm and a thickness of 5 mm, and has a roller resistance of $10^4$ to $10^5$ Ω.

In addition, the developing roller 5 and the photosensitive drum 1 are pressurized to contact, and when a peripheral speed of the photosensitive drum 1 is 50 mm/s, the developing roller 5 is rotated at a peripheral speed of 80 mm/s that is, slightly faster than the photosensitive drum 1.

Here, a resistance value is measured by causing the developing roller 5 to abut an aluminum roller with a diameter of 30 mm at an abutment load of 4.9 N to rotate the aluninum roller at a peripheral speed of 50 mm/s. Then, a direct-current voltage of 400V is applied to the developing roller 5. A resistor of 10 kΩ is disposed on a grounding side, voltages on its both ends are measured to calculate a current and a resistance of the developing roller 5. In addition, the length of the developing roller 5 in the longitudinal direction is set as 210 mm.

The toner 8 is a nonmagnetic single component developer and is excellent in a transfer nature as described above. Toner having an advantage such as less wear of the photosensitive drum 1 due to high lubricity at the time when transfer residual toner that was not transferred and remains on the photosensitive dram 1 is cleaned by cleaning means such as a blade and a fur brush, that is, toner with spherical particles with flat surface is used as the toner 8.

More specifically, a volume resistance value of the zoner 8 is $10^{14}$ Ωcm or more. A current amount is measured by an applied microcurrent meter (4140 pA METER/DC VOLTAGE SOURCE produced by Hewlett-Packard Japan, Ltd) under the conditions of a pressure of 980 g/cm$^2$ (96.1 kPa), a powder layer thickness at measurement of 0.5 to 1.0 mm and a direct-current voltage of 400V using a scale weight of a measurement electrode plate area at ϕ6 mm of 0.283 cm$^2$ and a pressure of 1500 g, to calculate a volume resistance value (resistivity) from the resistance value.

As a shape factor of the toner 8, SF-1 is 100 to 180 and SF-2 is 100 to 140. These shape factors SF-1 and SF-2 are defined as a value found by unintentionally sampling 100 toner images using FE-SEM (s-800) manufactured by Hitachi, Ltd., introducing information of the images in an image analyzing apparatus (Luzex3) manufactured by Nicole via an interface to analyze the information, and calculating using the following expressions. In the expressions below, "^" represents an exponent.

$$SF\text{-}1=(MXLNG)\hat{}2/\mathrm{AREA}\times\pi/4\times100$$

$$SF\text{-}2=(PER1)\hat{}2/\mathrm{AREA}\times\pi/4\times100$$

(AREA: toner projection area, MXLNG: absolute maximum length, PER1 circumference length)

The shape factor SF-1 of this toner 8 indicates a spherical degree. AS SP-1 gets larger, particles of the toner 8 gradually deform into unfixed shapes from spherical shapes.

The shape factor SF-2 indicates an unevenness degree. As SF-2 gets larger, unevenness on the surface of the toner particles becomes more evident.

As long as the toner 8 is within the above-mentioned shape factors, the toner 8 can be manufactured by a method, other than a method of manufacturing by a so-called grinding method, such as a method of directly generating the toner 8 using a suspension polymerization method described in Japanese Patent Publication No. Sho 36-10231 and Japanese Patent Application Laid-open No. Sho 59-53856, a dispersion polymerization method for directly generating the toner 8 using a organic solvent of water series in which monomer is soluble but polymer is insoluble, or an emulsion polymerization method represented by a soap free polymerization method for directly polymerizing to generate the toner 8 under the existence of a soluble polarity polymerization starter.

In this embodiment, the shape factors SF-1 and SF-2 of the toner 8 can be easily controlled to be 100 to 180 and 100 to 140, respectively. A colored suspension particle of a weight average particle diameter of 7 μm was manufactured by adding styrene and n-butyl acrylate as monomer, a salicylic acid metal compound as a charge control agent, a saturated polyester as a polar resin and a coloring agent using the suspension polymerization method under a normal pressure in which the particles of the toner 8 of 4 to 8 μm diameter with a sharp particle sized distribution can be relatively easily obtained or under pressurization.

Then, by externally adding 1.5 wt % of hydrophobic silica, the above-mentioned toner 8 of negative polarity was manufactured which was excellent in the transfer property and had less wear at the time when the photosensitive drum 1 was cleaned.

In the developing device 4 described above, the toner 8 in the developer container 14 is conveyed in the direction of the elastic roller 6 in accordance with the rotation in an arrow C direction of an agitating member 16 at the time of development operations.

Next, the toner 8 is then conveyed to the vicinity of the developing roller 5 by the elastic roller 6 rotating in an arrow D direction. The toner 8 borne on the elastic roller 6 is subject to frictional electrification by being rubbed against the developing roller 5 at the abutment part of the developing roller 5 and the elastic roller 6, and deposits on the developing roller 5.

A toner charging roller 18 as a developer charging member being a component of the present invention then abuts over an image forming region formed on the developing roller 5 in order to keep a electrification charge amount of the toner 8. The toner charging roller 18 charges the toner 8 by discharging.

The toner charging roller 18 is a rubber roller, and is closely filled and equally coated by the toner charging roller 18 abutting the developing roller 5 at the abutment load of 0.98 to 1.96 N using a pressuring member (not shown). It is preferable that the elastic blade 7 and the toner charging roller 18 are disposed in such a longitudinal positional relationship that the toner charging roller 18 surely covers the entire abutment area of the elastic blade 7 on the developing roller 5.

Figure 3:
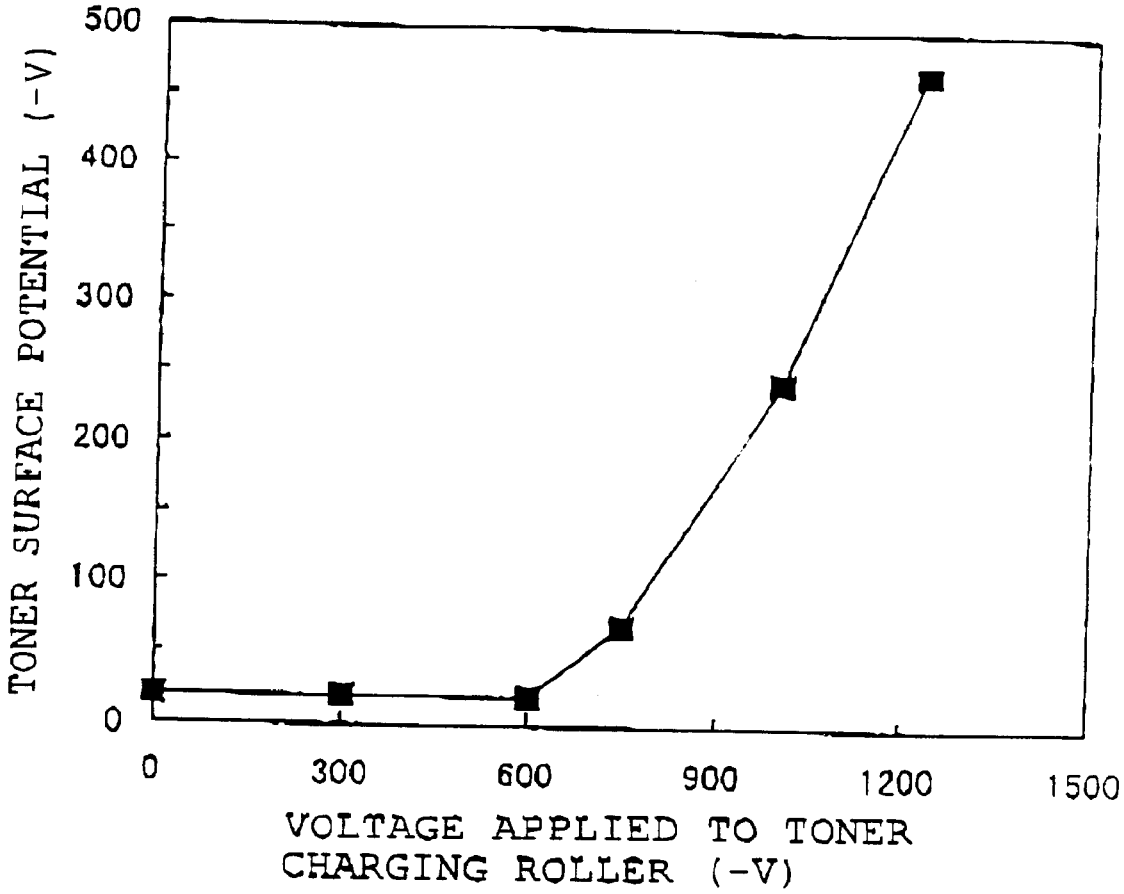
FIG. 3 is a graph of a toner discharging characteristic in a toner charging roller of the image forming apparatus shown in FIG. 1.

A method of giving a charge will be described below FIG. 3 is a graph of a toner discharging characteristic in the toner charging roller 18 of the image forming apparatus shown in FIG. 1. As shown in FIG. 3, if the resistance of the toner charging roller 18 is $10^8$ Ω, the toner discharging characteristic shows a behavior indicated by the solid line. The toner has a surface potential of −20V even under an applied voltage of 0V. This is because the elastic roller 6 and the elastic blade 7 receive a frictional electrification.

Figure 4:
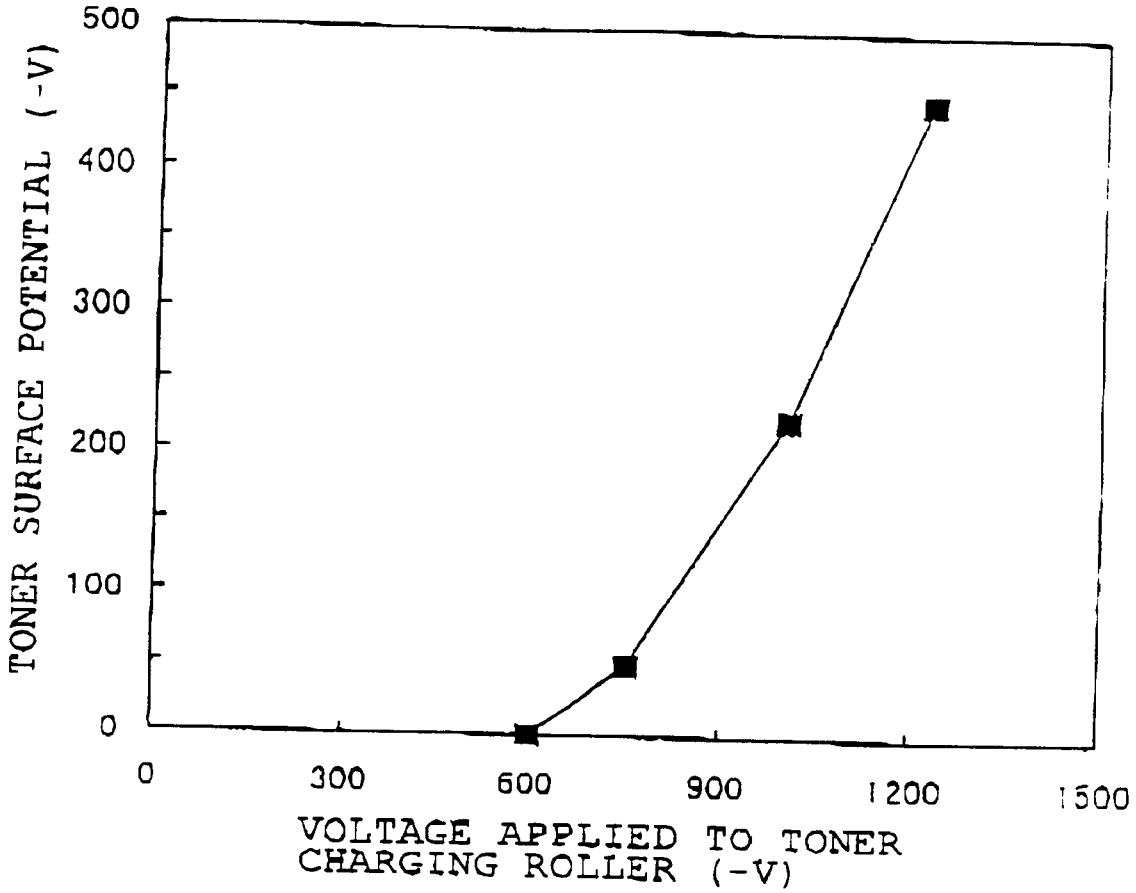
FIG. 4 is a graph of a toner discharging characteristic (excluding a toner potential) in the toner charging roller of the image forming apparatus shown in FIG. 1.

FIG. 4 is a graph of a toner discharging characteristic (excluding a toner potential) in the toner charging roller 18 of the image forming apparatus shown in FIG. 1. When a surface potential by this frictional electrification is excluded, a discharge starting voltage with the toner 8 rises from −600V at the inclination of 1 as indicated by the solid line of FIG. 4, and shows a behavior similar to a DC discharging charge against the photosensitive drum 1. A discharge starting voltage of the toner charging roller 18 and the toner 8 is determined by a point of intersection of expressions (1) and (2) shown below.

$$Vb=312+6.2\ g \quad (1)$$

$$Vg=g(Va-Vc)/[(Lt/Kt)+g]m \quad (2)$$

In the above expressions, g is a space distance,

Vb is the approximation formula of the Paschen's law when g>8 μm,

Vg is a voltage between gaps between the toner charging roller and the toner layer surface, Va is a voltage applied to a toner charging roller, Vc is a toner layer surface potential, Lt is a toner layer thickness, and Kt is a toner layer relative dielectric rate.

Figure 5:
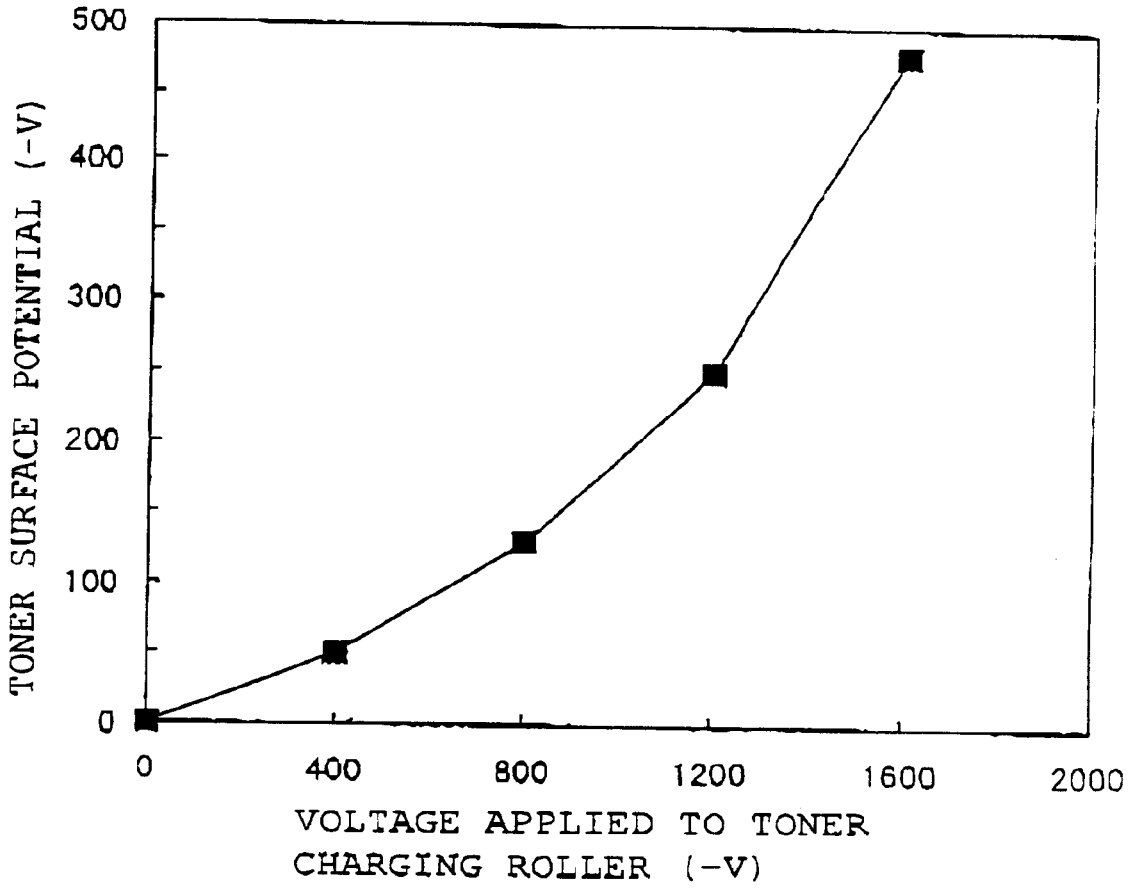
FIG. 5 is a graph of a toner charging characteristic in the case in which injection electrification of the image forming apparatus shown in FIG. 1.

FIG. 5 is a graph of a toner charging characteristic in the case of injection electrification of the image forming apparatus shown in FIG. 1. The toner 8 used in this embodiment is excellent in a particle size distribution, and the shape of the toner particles is spherical. Thus, a ratio of the toner 8 and the air in the toner layer is fixed, Kt in the expression (2) is stabilized, and a charge is given by a stable discharge. As another method of giving a charge to toner, there is the injection electrification. In this case, a voltage applied to a toner charging roller and a toner surface potential show a behavior shown in FIG. 5. Judging from the above results, it is seen that the method of giving a charge in this embodiment uses discharging.

The above-mentioned experiment was conducted in the case in which the entire longitudinal area of the toner charging roller 18 abutted a toner coated part. If a range of resistance in which toner discharge is possible is $10^7$ Ω or less, a voltage between the toner charging roller 18 and the toner coated part, under which toner discharge is possible, cannot be obtained. If the range of resistance is $10^{11}$ Ω or more, a discharge starting voltage is too large and inappropriate in a configuration as in this embodiment, Therefore, an appropriate range of a resistance of the toner charging roller 18 is $10^7$ to $10^{11}$ Ω. In this embodiment, if a resistance of the developing roller 5 uses $10^5$ Ω, it is within the appropriate range of the resistance of the toner charging roller 18.

A method of measuring a resistance is as described below. An aluminum roller with a diameter of 16 mm and the toner charging roller 18 are caused to abut at an abutment load of 1.666 N, and the aluminum roller is rotated at 80 mm/s. Then, a direct-current voltage of −400V is applied to the toner charging roller 18. A resistor of 10 kΩ is disposed on a grounding side, and voltages on its both ends are measured to calculate a current and a resistance of the toner charging roller 18. In addition, the length of the toner charging roller 18 in the longitudinal direction is set as 210 mm.

A toner layer on the developing roller 5 sufficiently charged by the toner charging roller 18 is conveyed to a developing part equally opposing the photosensitive drum 1. In this abutment part for developing, the toner layer formed in a thin layer on the developing roller 5 is developed as a toner image on an electrostatic latent image on the photosensitive drum 1 by a direct-current voltage of the developing roller 5.

Unused toner that was not consumed in the developing part is collected from the lower part of the developing roller 5 in accordance with the rotation of the developing roller 5. A sealing member 17 consisting of a flexible seat is provided in this collecting part, which allows passage of unused toner into the developer container 14 and prevents the toner 8 inside the developer container 14 from leaking from the lower part of the developing roller 5.

The collected unused toner on the developing roller 5 is scraped off from the surface of the developing roller 5 at the abutment part of the elastic roller 6 and the developing roller 5. Most of the scraped-off toner is conveyed in accordance with the rotation of the elastic roller 6 and mixed with the toner 8 in the developer container 14, whereby electrification charges of the toner 8 are dispersed. New toner 8 is simultaneously supplied onto the developing roller 5 by the rotation of the elastic roller 6, and the above-mentioned actions are repeated.

Figure 6:
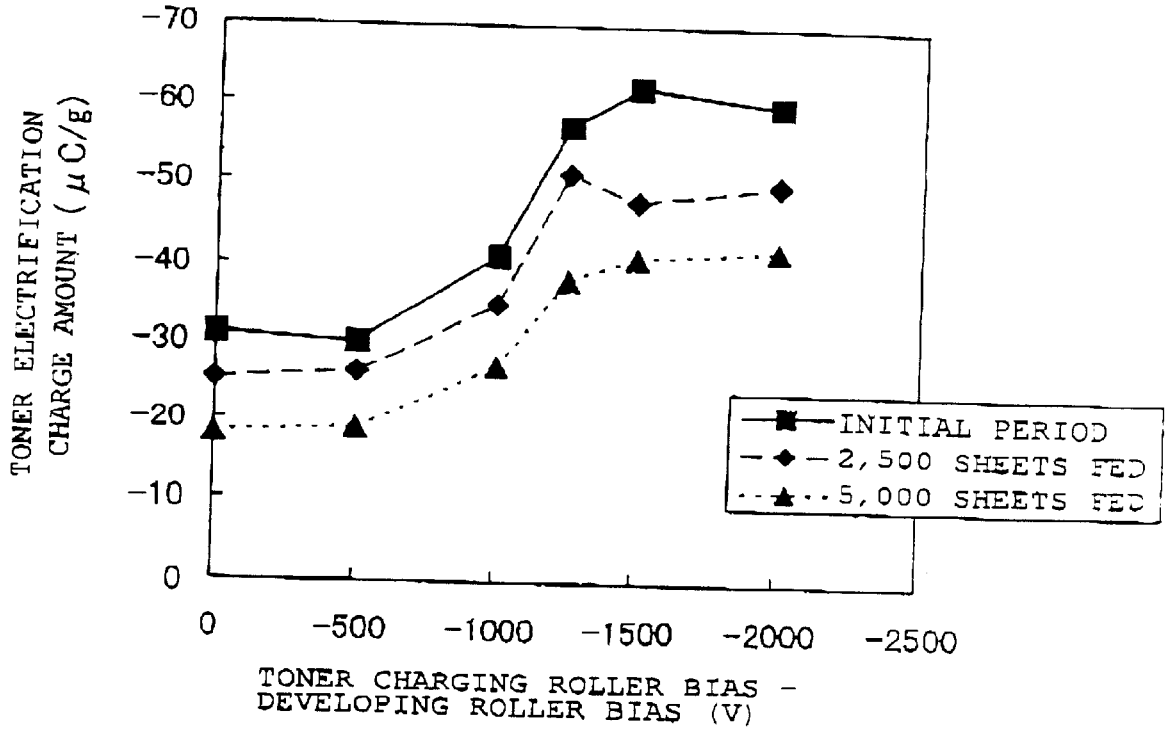
FIG. 6 is a graph of a relation between an applied voltage and an electrification charge amount of the toner charging roller in the image forming apparatus shown in FIG. 1.

A toner charge amount with respect to a potential difference between the developing roller 5 and the toner charging roller 18 will now be described. FIG. 6 is a graph showing an electrification charge amount of toner with respect to a voltage between the toner charging roller 18 and the toner 8 on the developing roller 5 when 2,500 sheets and 5,000 sheets are fed, respectively, at the time of an initial use in this embodiment. As shown in FIG. 6, an electrification charge amount of toner starts to saturate from approximately 1,200V, but a saturated charge amount of the toner 8 decreases from the time of an initial use until the time when 5,000 sheets are fed.

Figure 7:
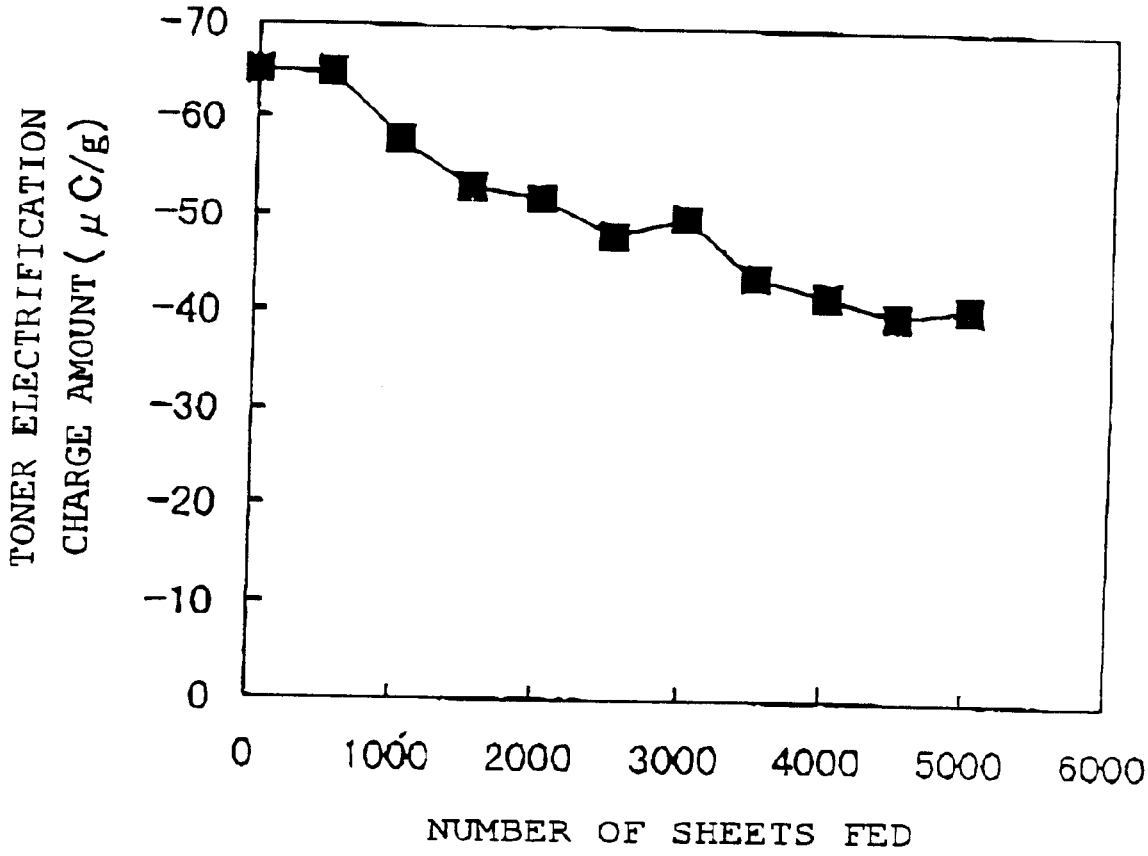
FIG. 7 is a graph of a relation between the number of fed sheets and an electrification charge amount in the case in which control of the present invention is not performed in the image forming apparatus shown in FIG. 1.
Figure 8:
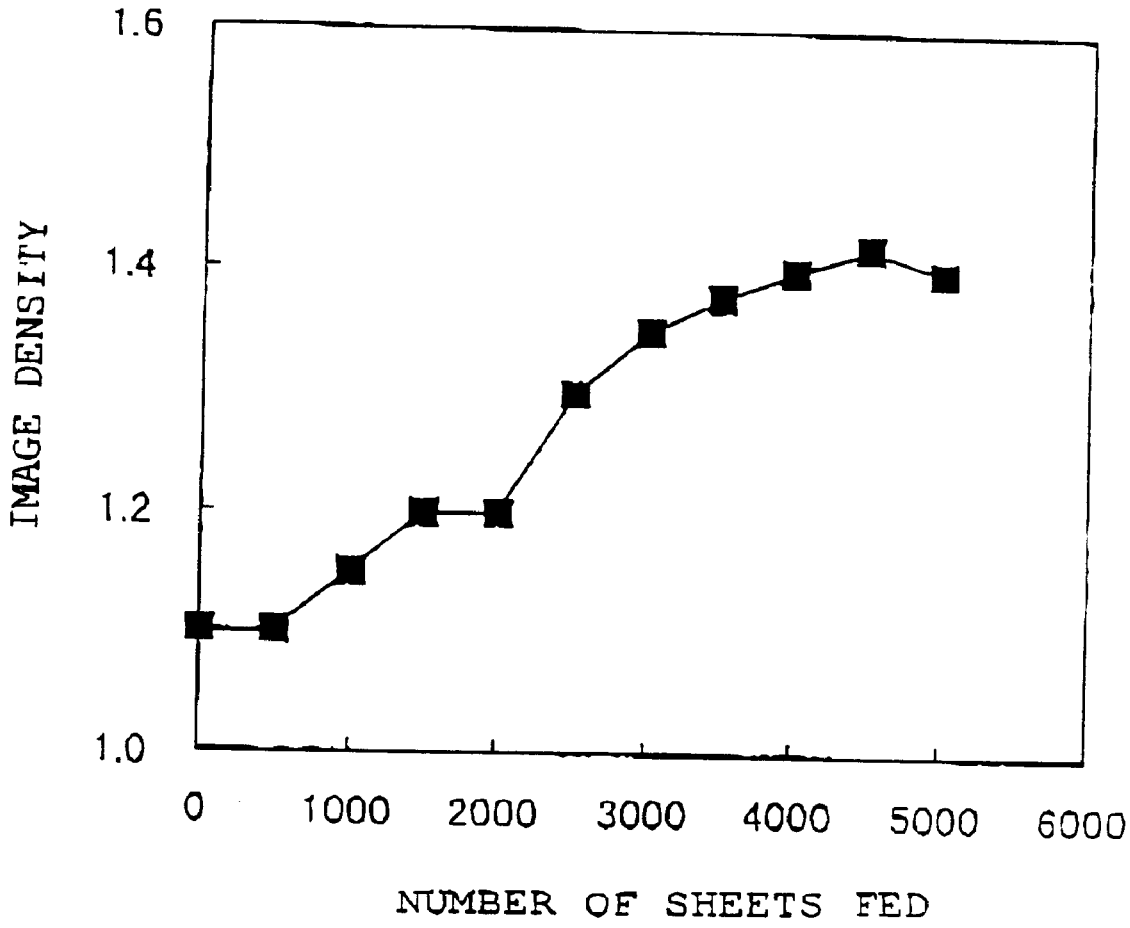
FIG. 8 is a graph of a relation between the number of fed sheets and an image density in the case in which control of the present invention is not performed in the image forming apparatus shown in FIG. 1.

It is considered that this is caused by toner deterioration due mainly to separation of an externally added agent, etc. In such a situation, variations of a toner charge amount and an image are shown in FIGS. 7 and 8, which occur in the case in which a potential difference between the toner charging roller 18 and the developing roller 5 is always constant and image forming operations are performed over a long period. FIGS. 7 and 8 are a graph of a relation between the number of fed sheets and an electrification charge amount and a graph of a relation between the number of fed sheets and image density, respectively, in the case in which control of the present invention is not performed in the image forming apparatus shown in FIG. 1.

In this case, a potential difference between the toner charging roller 18 and the developing roller 5 is set at 1,500V, a negative charge toner is used in this embodiment, and a voltage applied to the developing roller 5 is −400V and a voltage applied to the toner charging roller 18 is −1,900V. As shown in FIG. 7, a toner charge amount with respect to the number of fed sheets varies over time. As a result, a difference of images densities occurs between the time of an initial use and the time after a use over a long period as shown in FIG. 8.

Figure 9:
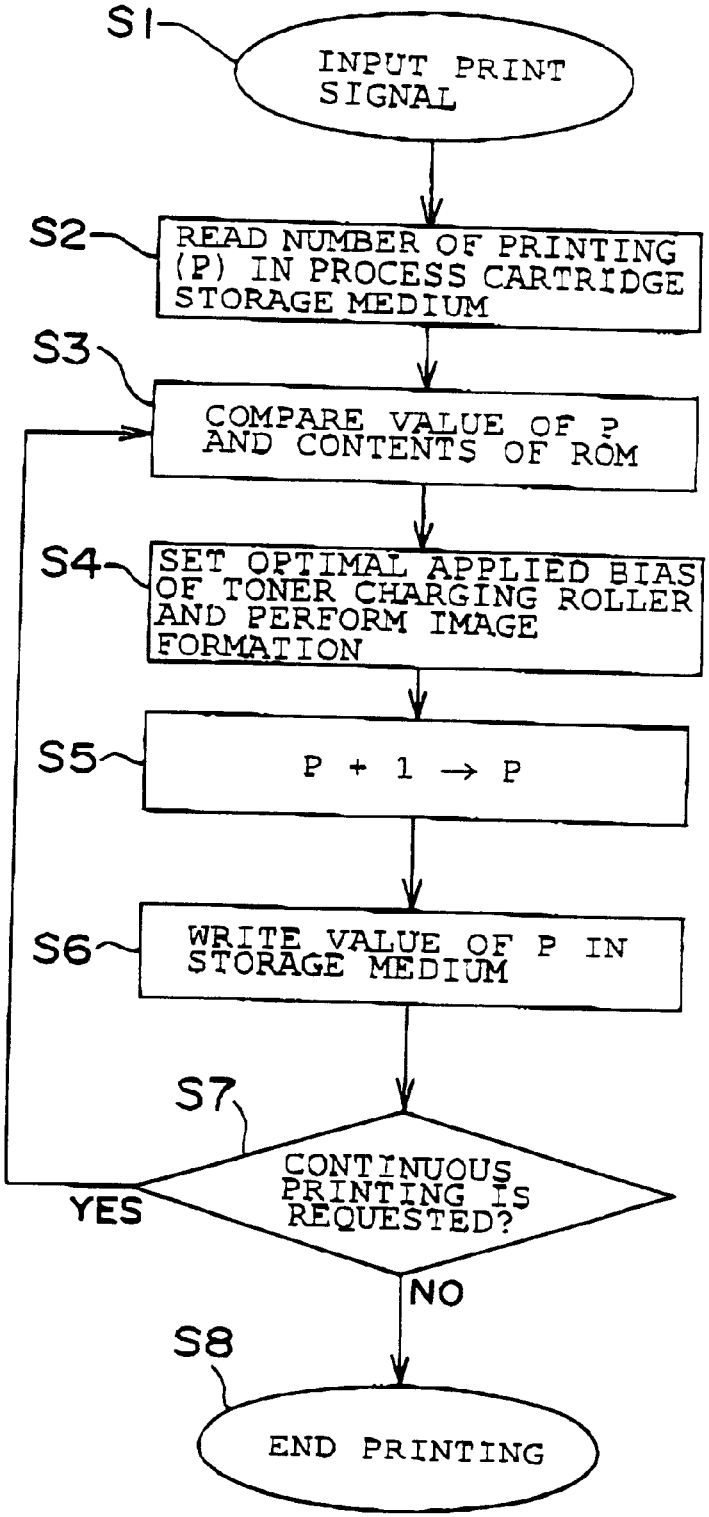
FIG. 9 is a control flowchart of the image forming apparatus shown in FIG. 1.

Thus, this embodiment is characterized in that, in order to prevent a change in a toner charge amount over time due to separation of an externally added agent or the like, a potential difference between the toner charging roller 18 and the developing roller 5 is variable, and a bias applied to the toner charging roller 18 is changed according to the number of printed sheets. A specific method of changing a bias will be described with reference to flowcharts of FIGS. 1 and 9. FIG. 9 is a control flowchart of the image forming apparatus shown in FIG. 1.

As shown in FIG. 1, a process cartridge of this embodiment is provided with a storage medium 19. The storage medium 19 stores the number of sheets printed using the process cartridge. When a print signal is inputted (S1), a CPU 20 on a main body of an image forming apparatus side communicates with the storage medium 19 provided in the process cartridge, and reads the number of sheets printed by the process cartridge (S2).

The CPU 20 compares an ROM 21 on a main body of an image forming apparatus side, in which a bias applied to the toner charging roller 18 is stored in advance according to the number of printed sheets, and the number of printed sheets read in the CPU 20 (S3). The CPU 20 then controls a power source 23 and a power source 24 by a bias controlling means 22 as controlling means being a component of the present invention, sets an optimal bias to be applied to the toner charging roller 18 and the developing roller 5, and advances to image forming operations (S4).

When a printing operation ends, the CPU 20 increases a count of the number of printed sheets by one (S5), and rewrites a number of printed sheet count of the storage medium 19 in the process cartridge (S6). The CPU subsequently determines if a continuous printing is requested (S7). If there is no request, the process advances to a print ending operation (S8). If there is such a request, the CPU 20 repeats the operations of S3 to S7 until continuous printing is not requested any more.

Figure 10:
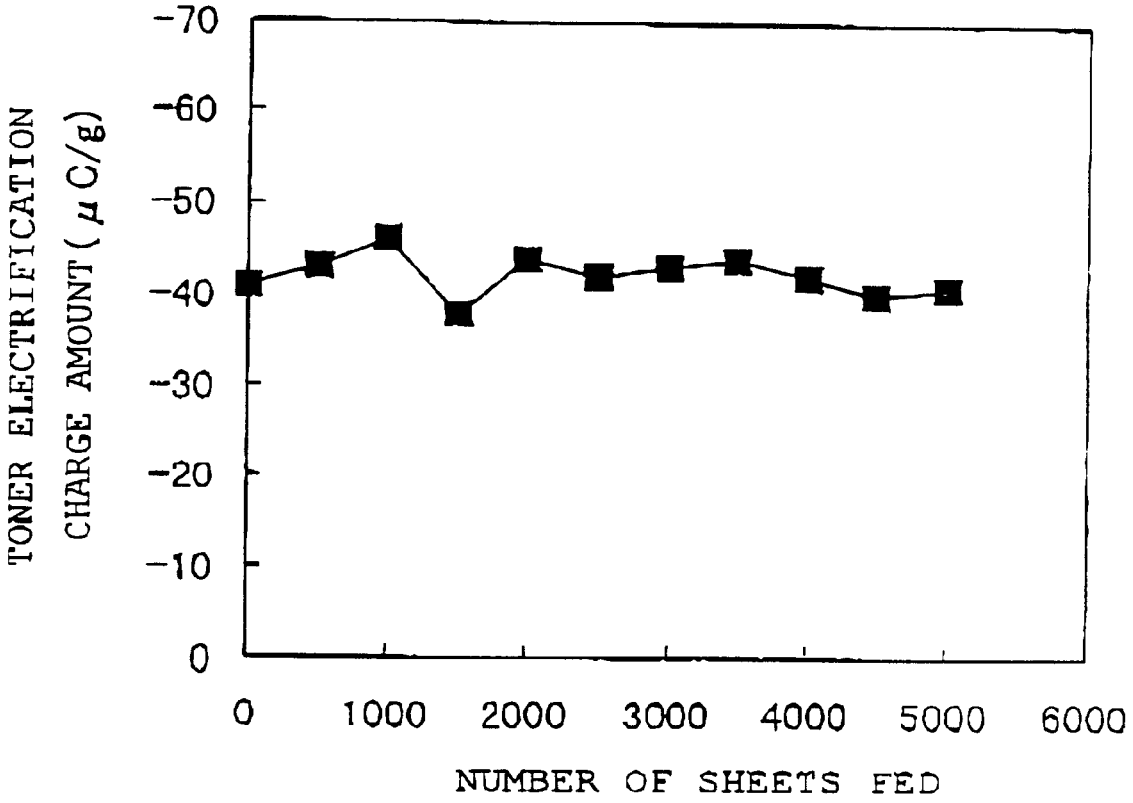
FIG. 10 is a graph of a relation between the number of fed sheets and an electrification charged amount of the image forming apparatus shown in FIG. 1.
Figure 11:
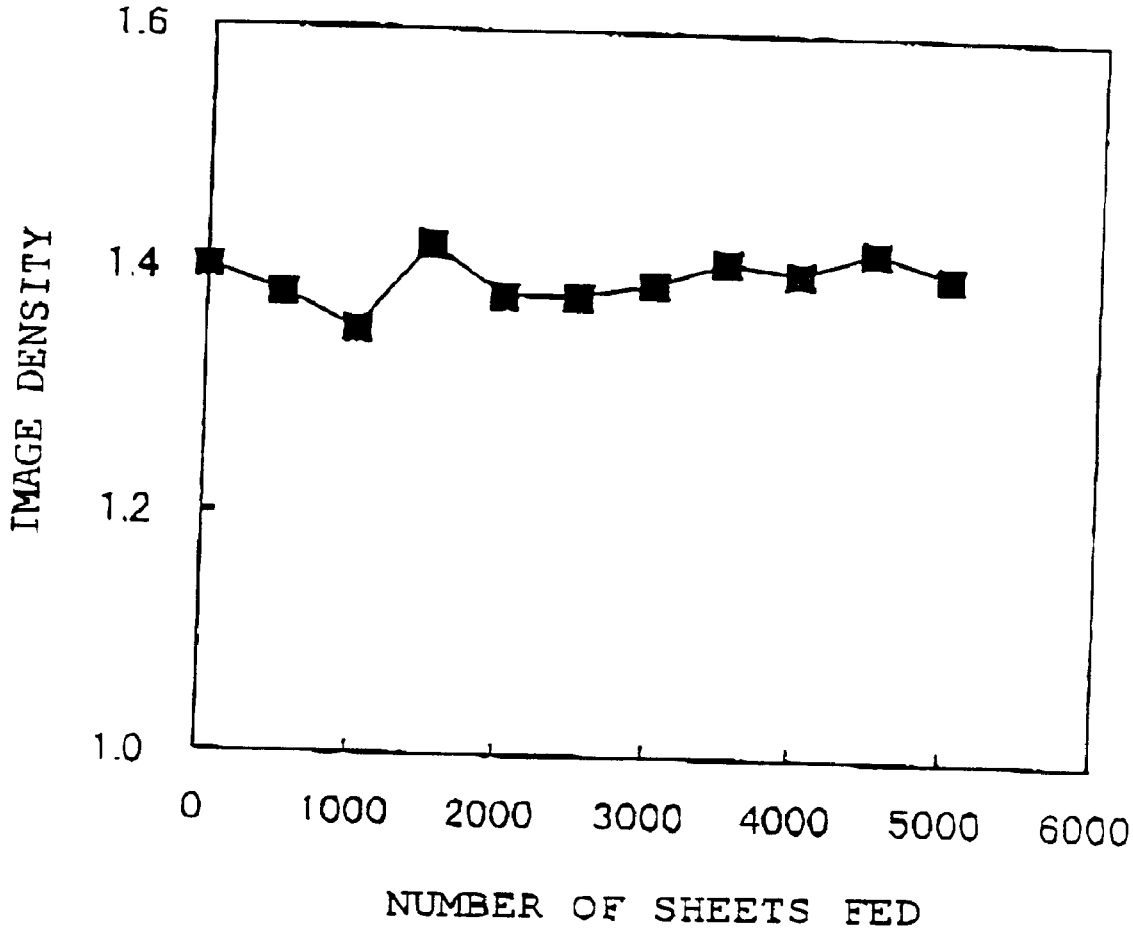
FIG. 11 is a graph of a relation between the number of fed sheets and an image density of the image forming apparatus shown in FIG. 1.

FIGS. 10 and 11 are graphs of a relation between the number of fed sheets and an electrification charge amount and a graph of a relation between the number of fed sheets and an image density, respectively, in the image forming apparatus shown in FIG. 1 in accordance with this embodiment. In this embodiment, a printing bias of the toner charging roller 18 is set to be variable to increase for each printing of 500 sheets. Thus, as shown in FIGS. 10 and 11, a toner charging amount and an image density are stable over a long period, and an image forming apparatus that is always capable of giving high image quality can be provided.

In this embodiment, a bias applied to the toner charging roller 18 is varied at the frequency of once in the printing of 500 sheets. However, a bias varying frequency may be changed according to a stability of a toner charge amount.

In addition, contents to be stored in the storage medium 19 are not specifically limited to the number of printed sheets as long as the contents are those related to toner deterioration such as duration of rotation of the developing roller 5 and duration of bias application.

Further, in the first embodiment, the process cartridge consisting of the developing device 4 that is detachably attachable to the main body of the image forming apparatus may be plural. In particular, the process cartridge may be used in a color electrophotographic method requiring a property of stable gradation of each color, that is, a stable electrification charge amount.

In addition, the process cartridge of this embodiment is used as a process cartridge consisting of the developing device 4 that is detachably attachable to the main body of the image forming apparatus. However, the process cartridge of this embodiment may be used as a process cartridge that is detachably attachable to the bearing device main body and in which the developing device 4, the photosensitive drum 1, the cleaning blade 10, the waste toner container 11, and the charging device 2 are integrally formed.

(Second Embodiment)

Figure 12:
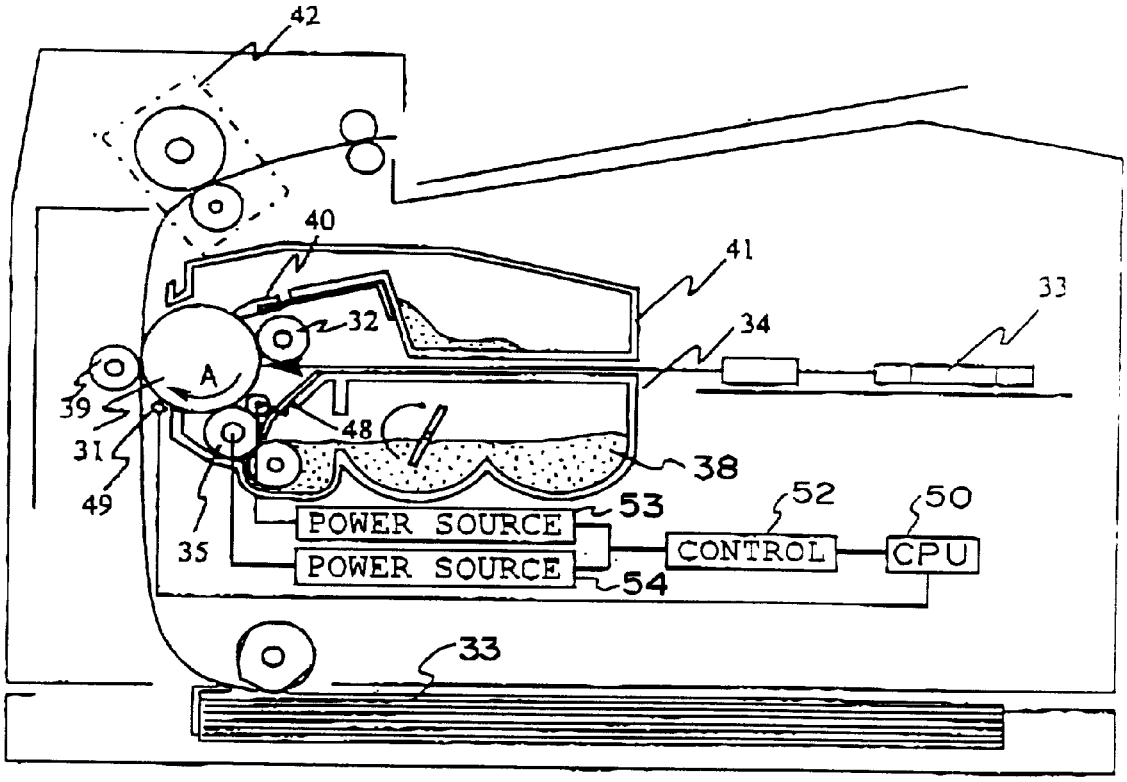
FIG. 12 is a schematic sectional view of an image forming apparatus using a second embodiment of the developing device in accordance with the present invention.

A second embodiment of a developing device in accordance with the present invention will be hereinafter described based on the attached drawings. The image forming apparatus of the second embodiment is characterized in that an image density is controlled by varying a bias applied to a toner charging roller. FIG. 12 shows a schematic sectional view of an image forming apparatus to which the developing device of the second embodiment is applied.

In addition, the developing device shown in FIG. 12 is disposed adjacent to a photosensitive drum 31 as in the first embodiment, and is detachably attachable to the image forming apparatus as a process cartridge.

The image forming apparatus in the second embodiment, a density sensor 49 as density detecting means being a component of the present invention is disposed adjacent to the photosensitive drum 31 on the downstream side of a developing position and the upstream side of a transferring position of the photosensitive drum 31 as an image bearing member being a component of the present invention. As described above, the image forming apparatus cannot obtain a proper image density when a toner charge amount fluctuates according to the number of printed sheets.

Therefore, patch images are experimentally created on the photosensitive drum 31 by toner 38, reflected light amounts are detected by the density sensor 49 consisting of a light emitting element and a light receiving element to find densities of the patch images, and image density control is performed by applying feedback to a toner charging roller 48 in response to the results, whereby a stable image is obtained.

Further, the density sensor 49 uses infrared rays, and can estimate an output image density by detecting a reflection density of a patch image received by the light receiving element. A target image density of 1.4 is realized from the toner 38 used in this embodiment when the reflection density is 1.2.

Figure 13:
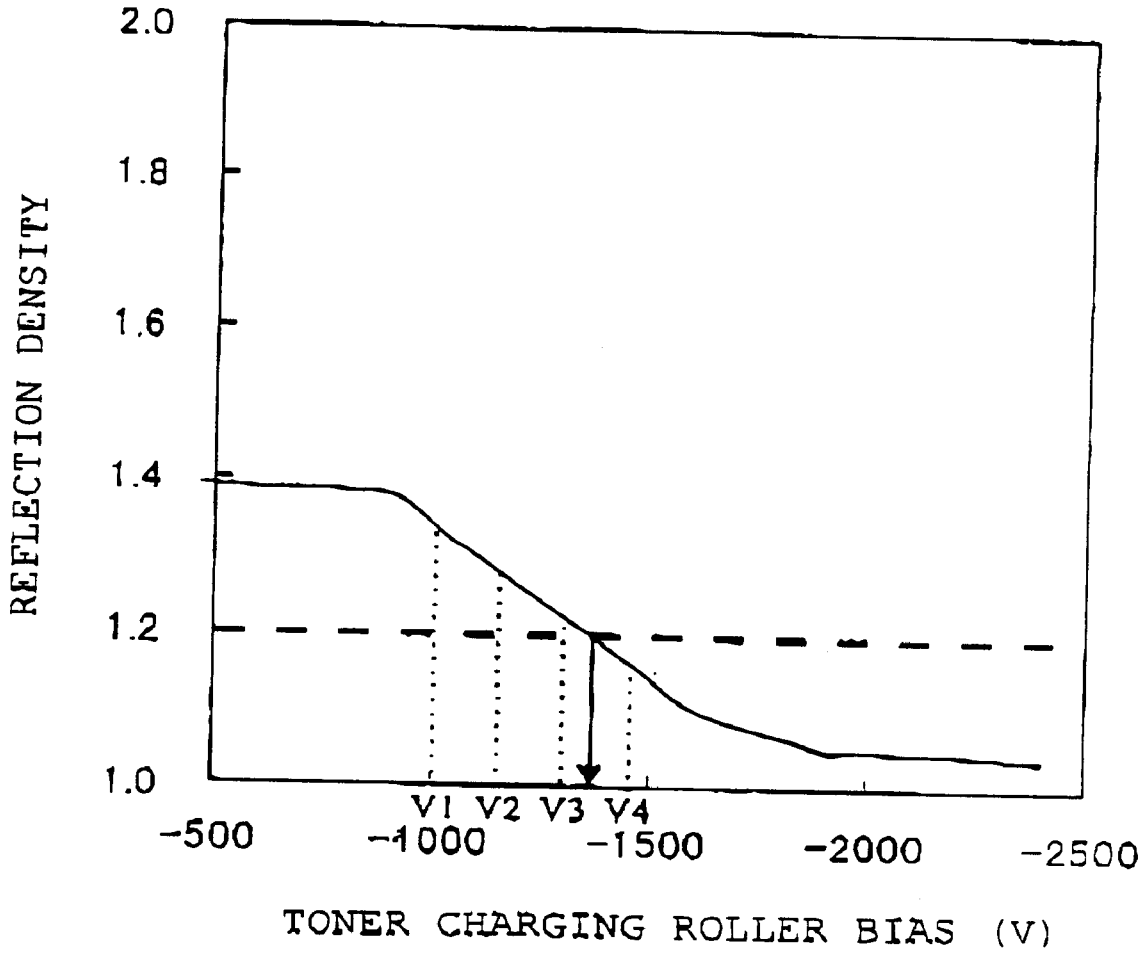
FIG. 13 is a graph of a relation between an applied voltage and a reflection density of a toner charging roller in the image forming apparatus shown in FIG. 12.

In FIG. 13, in accordance with an increase of a toner charging roller bias, a reflection density decreases. This is because a mirror image force against the toner 38 increases due to an increase of a charge amount of the toner 38, which makes it less likely that the toner 38 flies to the photosensitive drum 31.

In FIG. 13, in accordance with an increase of a toner charging roller bias,a reflection density decreases. This is because a mirror image force against the toner 38 increases due to an increase of a charge amount of the toner 38, which makes it less likely that the toner 38 flies to the photosensitive drum 31.

As shown in FIG. 6, a toner charge amount starts to increase from a point where a potential difference between the toner charging roller 48 and a developing roller 35 is approximately 600V, and saturates at a point where the potential difference is around 1,200V.

Therefore, a toner charging roller bias is varied between points where a potential difference is 600 to 1,200V, patch density detection results are linearly approximated, and a toner charging roller Bias to make a reflection density 1.2 is calculated and set, whereby an optimal image density (1.4 in this embodiment) is realized.

In this embodiment, V1, V2, V3 and V4 are used as voltage values to be applied to the toner charging roller 48 when a patch patent image is developed. The voltage values are −1,000V, −1,200V, −1,400V and −1,600V, respectively.

At this point, a bias of the developing roller 35 is fixed at −400V, and potential differences between the developing roller 35 and the toner charging roller 48 are 600V, 800V, 1,000V and , 1,200V, respectively.

Figure 14:
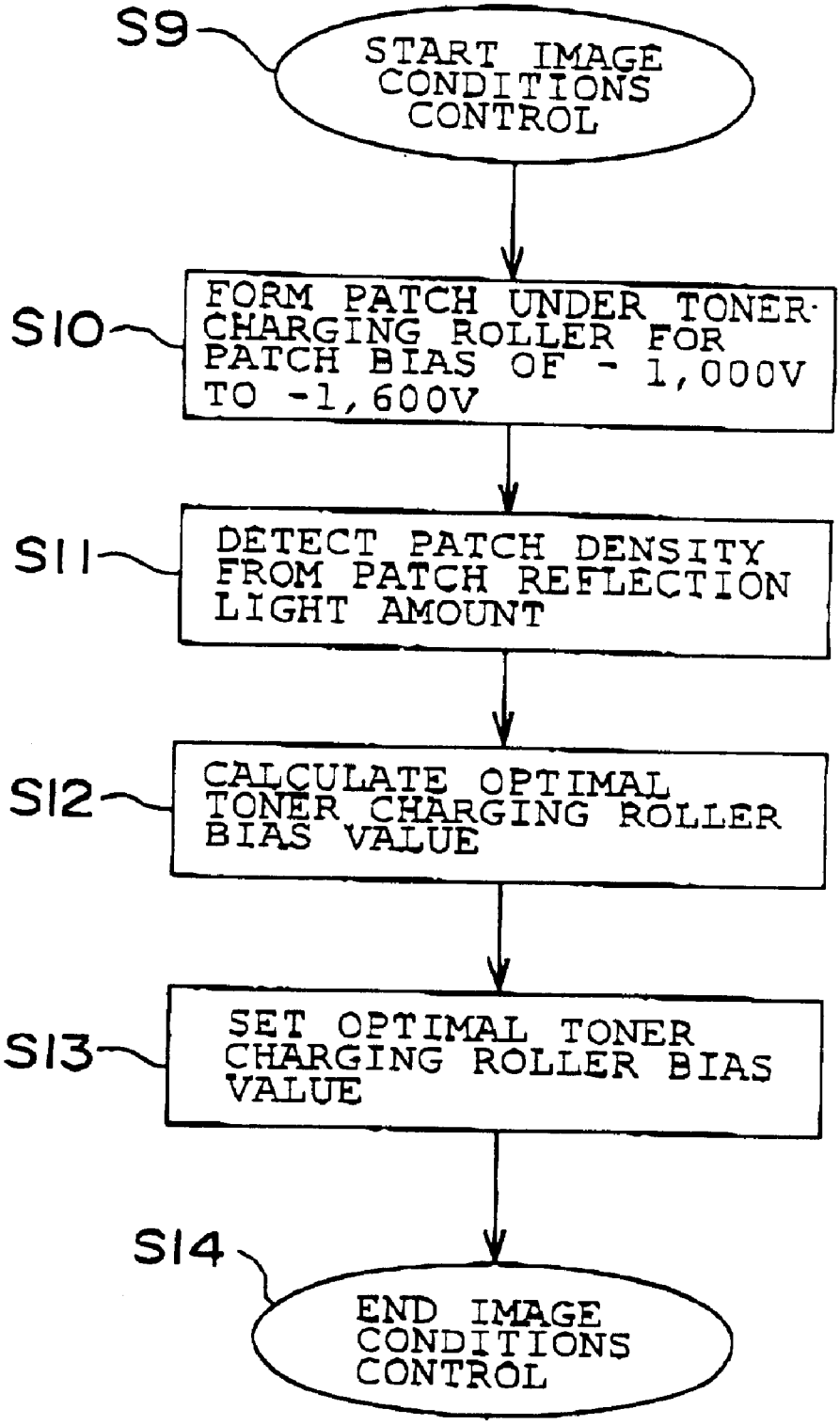
FIG. 14 is a control flowchart of the image forming apparatus shown in FIG. 12.

A specific image density controlling method of this embodiment will be described with reference to FIG. 12 and a flowchart of FIG. 14. FIG. 14 is a control flowchart of an image forming apparatus shown in FIG. 12.

First, when moving to an image density controlling operation (S9), a CPU 50 as development conditions controlling means being a component of the present invention creates patch latent images exposed at a predetermined light amount by an exposing unit 33 by varying patches P1, P2, P3 and P4 while varying a toner charging roller bias by bias controlling means 52 (S10).

In this embodiment, the surface of the photosensitive drum 31 is equally charged at −700V as a dark part potential VD by a charger 32, and scan exposure is then applied to the surface of the photosensitive drum 31 by a laser beam ON/OFF controlled by the exposing unit 33 according to patch forming image information, whereby a patch latent image of −100V as a light part potential VL is formed.

A toner charging roller bias, which increases at a predetermined stage while corresponding to the patch latent image, is outputted from the bias controlling means 52. Then, the patch latent image on the photosensitive drum 31 is visualized on the photosensitive drum 31 as a patch toner image having a different density. Reflected light amounts of these patch toner images formed in this way are measured by the density sensor 49 (S11). A toner charging roller bias at which a desired constant density (a reflection density of 1.2 in this embodiment) is estimated to be obtained is found (S12), and a bias value is outputted. Results of the patch density measurement are thereby fed back to a developing unit (S13), the image density control is finished (S14), and image formation is executed based on the fed-back results.

Figure 15:
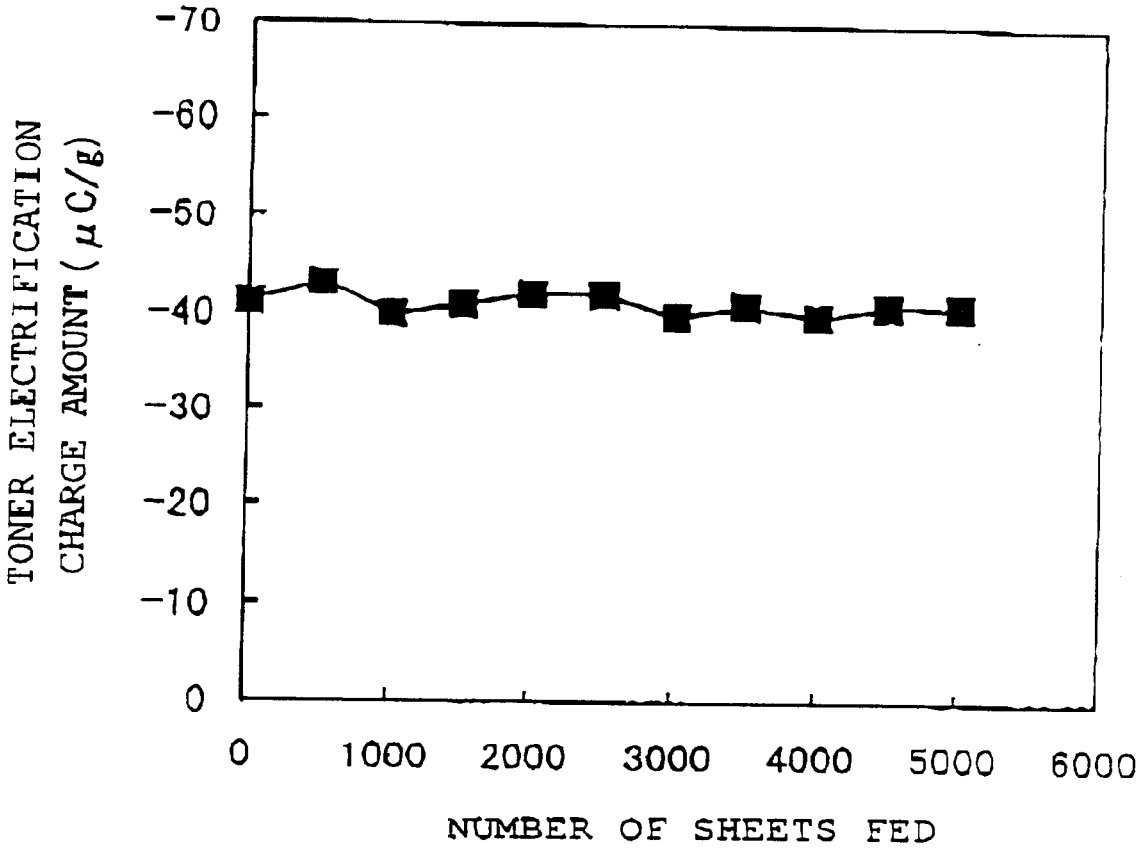
FIG. 15 is a graph of a relation between the number of fed sheets and an electrification charge amount of the image forming apparatus shown in FIG. 12.
Figure 16:
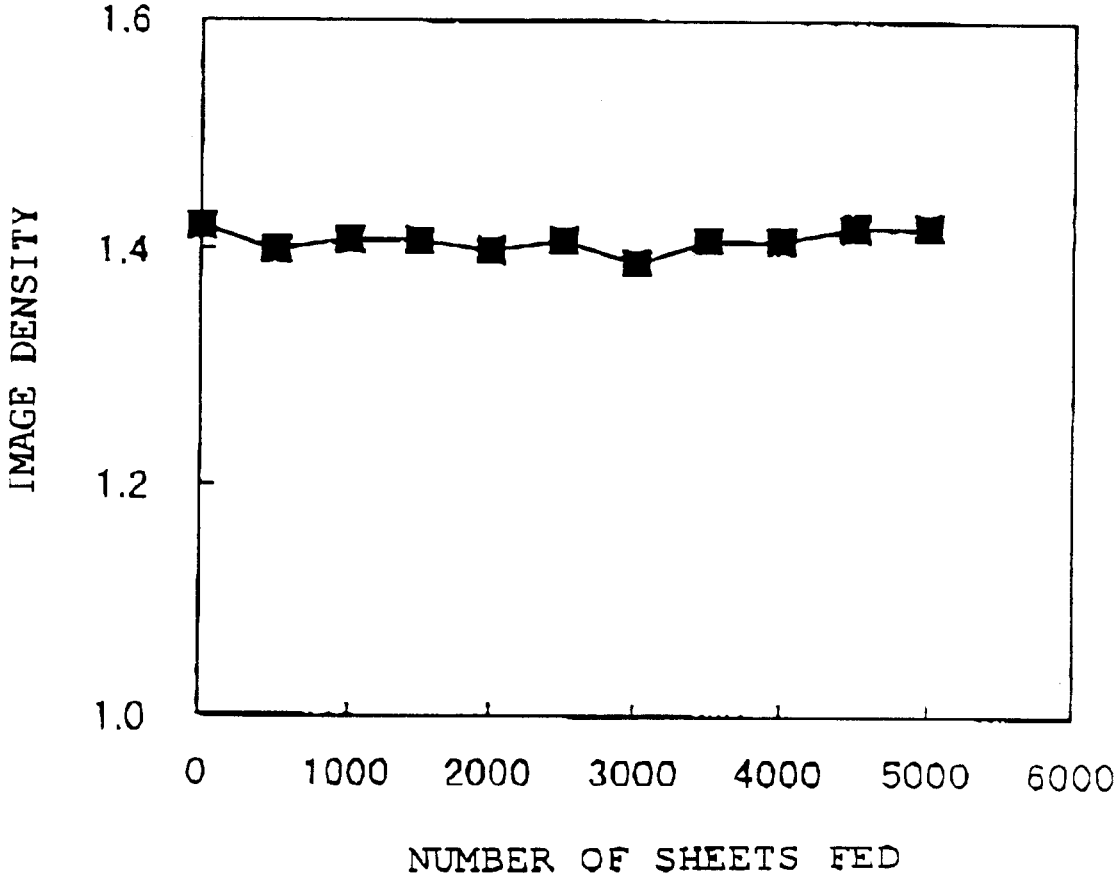
FIG. 16 is a graph of a relation between the number of fed sheets and an image density of the image forming apparatus shown in FIG. 12.
Figure 17:
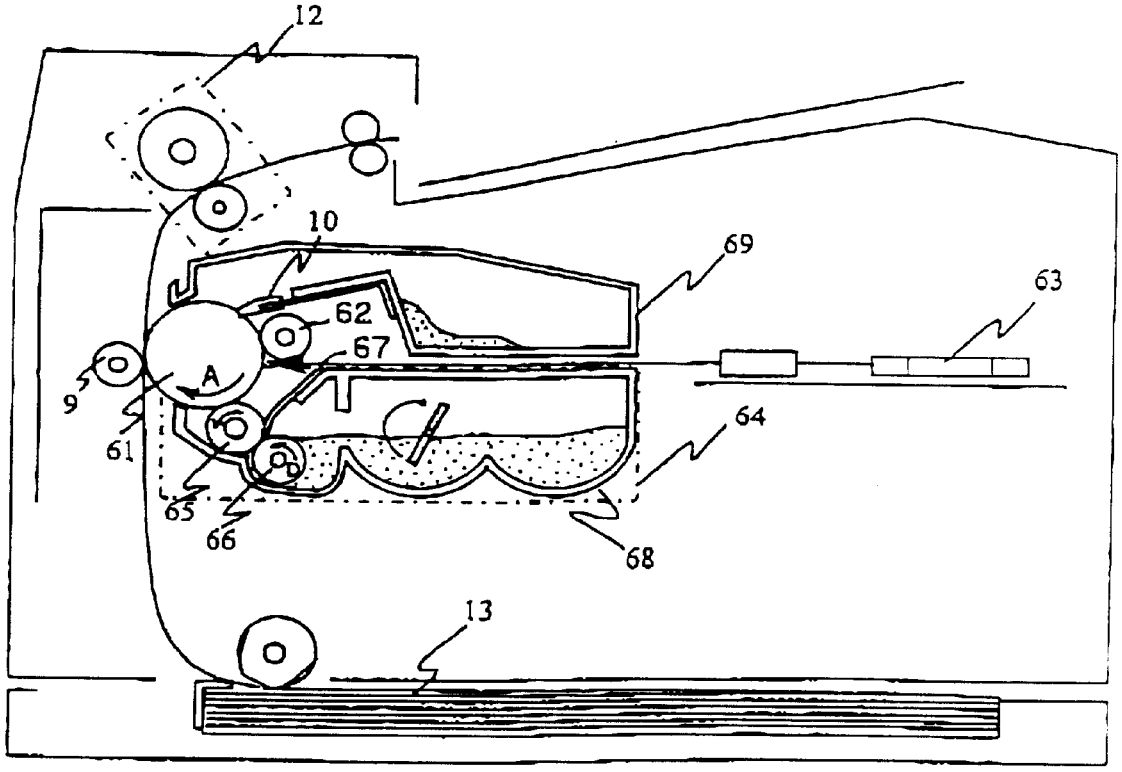
FIG. 17 is a schematic sectional view of an image forming apparatus using a conventional DC contact single component development method.
Figure 18:
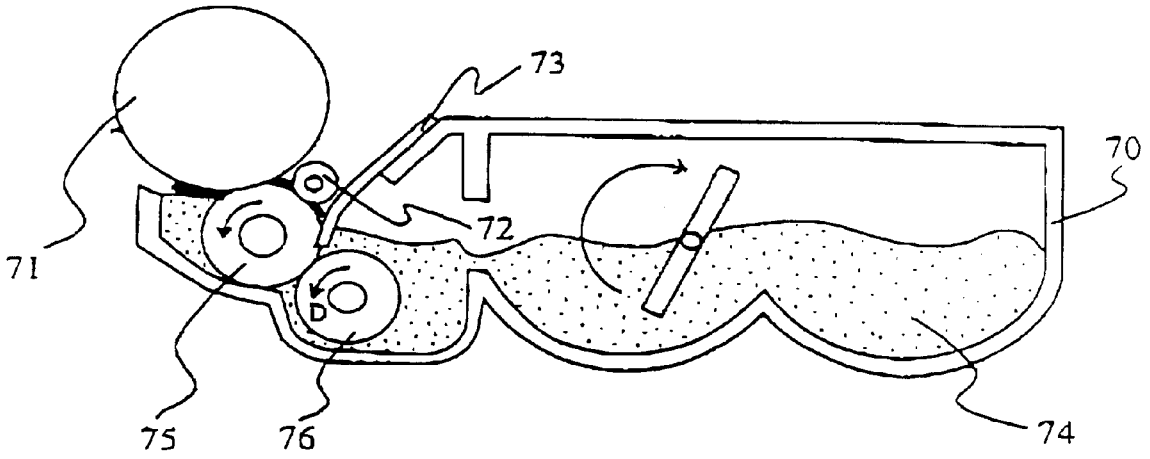
FIG. 18 is a schematic sectional view of a developing device of a contact developing method using a conventional toner charging roller.

Although it is described that image density control is performed at a frequency of once in printing 500 sheets in this embodiment, a control frequency may be changed according to a stability of used toner. FIG. 15 shows a relation between the number of fed sheets and a toner charge amount in this embodiment. FIG. 16 shows a relation between the number of fed sheets and an image density. The image density control is performed by varying a bias of the toner charging roller 48 in this embodiment. As a result, as shown in FIGS. 15 and 16, a toner charge amount can be surely stabilized over a long term use, and a image density is also stabilized and a high image quality can be always realized.

Moreover, the process cartridge consisting of the developing device detachably attachable to the main body of the image forming apparatus may be plural in the second embodiment. The process cartridge may be used in a color electrophotographic method requiring a property of stable gradation of each color, that is, a stable electrification charge amount.

In addition, the process cartridge of this embodiment is used as a process cartridge consisting of a developing device detachably attachable to the main body of the image forming apparatus. However, the process cartridge may be used as a developing device configured to be fixed inside a main body of an image forming apparatus and supplies toner only. Alternatively, the process cartridge may be used as a process cartridge that is detachably attachable to a main body of an image forming apparatus and in which a developing device, a photosensitive drum, a cleaning blade, a waste toner container and a charging device are integrally formed.

As described above, according to the present invention, a first voltage is applied to the developer bearing member and a second voltage is applied to the developer charging member, and a potential difference between the first voltage applied to the developer bearing member and the second voltage applied to the developer charging member is variably controlled by the controlling means. Thus, sufficiently charged toner can be steadily supplied and a high image quality can always be given.

In addition, the controlling means is configured to control the difference of the potentials according to a use state. Thus, sufficiently charged toner can be steadily supplied even if the developing device is used for a long period of time, and a high image quality can always be given.

Moreover, in the present invention, a potential difference in forming an image is determined according to densities of a plurality of pattern images that are formed using the developing device by changing the potential difference, and the developing device has the density detecting means for detecting a density of a pattern image. Thus, an image forming apparatus can be provided which can always steadily supply sufficiently charged toner even when the image forming apparatus is used for a long period of time and can always give a high image quality.

In addition, convenience of a user can be improved because the developing device and the image bearing member are provided in the process cartridge detachably attachable to the image forming apparatus.

Further, the descriptions of the above-mentioned embodiments do not limit the scope of the present invention at all, and various modifications are possible when appropriate as long as those having ordinary skills in the art can understand such modifications.

What is claimed is:

1. A developing device, comprising:

a developer bearing member for bearing and conveying a developer in order to apply the developer to an image bearing member, wherein a first voltage is applied to said developer bearing member;

a developer charging member for charging the developer borne by said developer bearing member, wherein a second voltage is applied to said developer charging member; and controlling means for variably controlling a potential difference between said first voltage and said second voltage, wherein said controlling means controls said potential difference according to information concerning a state of usage of said developing device.

2. A developing device according to claim 1, wherein said information concerning a use state of said developing device is a number of times of image forming operations applied to said image bearing member by said developing device.

3. A developing device according to claim 2, wherein an image is formed on a recording material using said image bearing member, and said information concerning a use state of said developing device is a number of recording materials on which an image is formed.

4. A developing device according to claim 2, wherein said information concerning a use state of said developing device is a number of rotations of said developer bearing member.

5. A developing device according to claim 2, wherein said information concerning a use state of said developing device is a duration of applying said first voltage.

6. A developing device according to any one of claims 2 to 5, wherein said developing device has a storage medium for storing said information.

7. A developing device according to any one of claims 2 to 5, wherein said developing device is provided in a cartridge that is detachably attachable to a main body of an image forming apparatus, and said cartridge has a storage medium for storing said information.

8. A developing device according to claim 7, wherein said cartridge is provided with said image bearing member.

9. A developing device according to claim 8, wherein the density of said plurality of pattern images is detected by a density detecting sensor.

10. A developing device according to claim 1, wherein said developing device and said image bearing member are provided in an image forming apparatus.

11. A developing device, comprising:

a developing bearing member for bearing and conveying a developer in order to apply the developer to an image bearing member, wherein a first voltage is applied to said developer bearing member;

a developer charging member for charging the developer borne by said developer bearing member, wherein a second voltage is applied to said developer charging member; and controlling means for variably controlling a potential difference between said first voltage and said second voltage, wherein said controlling means varies said second voltage to form a plurality of pattern images while maintaining said first voltage to be constant, and controls said second voltage in the case of images being formed in accordance with a density of said plurality of pattern images.

12. A developing device according to claim 11, wherein said developing device and said image bearing member are provided in an image forming apparatus, and said image forming apparatus has density detecting means for detecting the densities of said pattern images.

13. A developing device according to claim 11, wherein said developer bearing member and said developer charging member are formed in a roller shape.

14. A developing device according to claim 11, wherein said developing device is provided in a process cartridge, which is detachably attachable to a main body of an image forming apparatus, together with said image bearing member.

* * * * *

UNITED STATES PATENT AND TRADEMARK OFFICE

CERTIFICATE OF CORRECTION

PATENT NO. : 6,470,153 B2
DATED : October 22, 2002
INVENTOR(S) : Shinji Uehara

It is certified that error appears in the above-identified patent and that said Letters Patent is hereby corrected as shown below:

Title page, Item [54] and Column 1, line 4,
"VOLTAGE" should read -- VOLTAGE, --.

Column 2,
Line 23, "deterica-" should read -- deteriora- --.
Line 51, "thorn" should read -- thin --.

Column 3,
Line 25, "born" should read -- borne --.

Column 4,
Line 40, "apparatus" should read -- apparatus. --.
Line 49, "an" should read -- a --.
Line 60, "in which" should read -- of --.

Column 7,
Line 32, "is," should read -- is --.
Line 50, "zoner" should read -- toner --.
Line 54, "Ltd)" should read -- Ltd.) --.

Column 8,
Line 6, "an unevenness degree." should read -- a degree of unevenness. --.
Line 10, "AS" should read -- As --.
Line 23, "a" should read -- an --.

Column 9,
Line 5, "below" should read -- below. --.
Line 26, "Vg=g(Va-Vc)/[(Lt/Kt)+g]tm (2)" should read -- Vg=g(Va-Vc) / [(Lt/Kt)+g] (2) --.

UNITED STATES PATENT AND TRADEMARK OFFICE

CERTIFICATE OF CORRECTION

PATENT NO. : 6,470,153 B2
DATED : October 22, 2002
INVENTOR(S) : Shinji Uehara

It is certified that error appears in the above-identified patent and that said Letters Patent is hereby corrected as shown below:

Column 12,
Line 46, "1-2" should read -- 1.2

Fig. 13 is a graph of a relation between an applied voltage of a toner charging roller and a reflection density in the image forming apparatus shown in Fig. 12. A reflection density has a correlation with an amount of toner deposited on the photosensitive drum 31, and has an amount and a charge amount of toner deposited on the photosensitive drum 31 when a developing bias is constant. Thus, a toner charging roller bias value and a reflection density have a correlation as indicated by a solid line in Fig. 13. --

Lines 53 through 58, should be deleted.
Line 67, "Bias" should read -- bias --.

Signed and Sealed this

First Day of July, 2003

JAMES E. ROGAN
*Director of the United States Patent and Trademark Office*